US008708734B2

(12) United States Patent
Su et al.

(10) Patent No.: US 8,708,734 B2
(45) Date of Patent: Apr. 29, 2014

(54) CABLE ASSEMBLY

(75) Inventors: Ping-Sheng Su, New Taipei (TW); Xiao-Li Li, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 198 days.

(21) Appl. No.: 13/193,494

(22) Filed: Jul. 28, 2011

(65) Prior Publication Data

US 2012/0028495 A1 Feb. 2, 2012

(30) Foreign Application Priority Data

Jul. 30, 2010 (CN) ..... 2010 2 0277019

(51) Int. Cl.
*H01R 13/58* (2006.01)

(52) U.S. Cl.
USPC ..... 439/452; 439/607.41

(58) Field of Classification Search
USPC ..... 439/449, 452, 607.41, 607.46, 607.51, 439/607.58
See application file for complete search history.

(56) References Cited

U.S. PATENT DOCUMENTS 2,410,618 A * 11/1946 Zelov ..... 439/97
2,659,872 A * 11/1953 Gilbert ..... 439/248
3,277,421 A * 10/1966 Gobrecht ..... 439/289
3,408,618 A * 10/1968 Hubbell ..... 439/695
4,634,208 A * 1/1987 Hall et al. ..... 439/607.51
4,685,758 A * 8/1987 Yoshida ..... 439/606
4,941,850 A * 7/1990 Ankers et al. ..... 439/607.51
4,960,389 A * 10/1990 Frantz et al. ..... 439/404
5,427,549 A * 6/1995 Smith et al. ..... 439/701
6,129,561 A * 10/2000 Lok ..... 439/76.1
7,500,878 B2 * 3/2009 Akino ..... 439/607.41
D610,095 S * 2/2010 Wu et al. ..... D13/147
7,845,983 B2 * 12/2010 Kawada et al. ..... 439/607.46
8,303,342 B2 * 11/2012 Shi et al. ..... 439/607.41
2011/0195593 A1 * 8/2011 McGrath et al. ..... 439/345

FOREIGN PATENT DOCUMENTS

CN 201081834 Y 7/2008

* cited by examiner

*Primary Examiner* — Neil Abrams
*Assistant Examiner* — Travis Chambers
(74) *Attorney, Agent, or Firm* — Wei Te Chung; Ming Chieh Chang

(57) ABSTRACT

A cable assembly, comprising a housing having a main portion, a plurality of conductive terminals received in the main portion of the housing, a cable having a plurality of wires and a metal shell with a no-joint-line surface enclosing the housing and comprising a front portion enclosing the housing and a rear portion enclosing the cable and a receiving space passing through the front portion and the rear portion.

19 Claims, 6 Drawing Sheets

CABLE ASSEMBLY

FIELD OF THE INVENTION

The present invention relates to a cable assembly, and more particularly to a cable assembly having a metal shell for preventing EMI.

DESCRIPTION OF PRIOR ART

Recently, a cable assembly always includes a metal shell, an insulative housing received in the metal shell, a plurality of conductive terminals received in the insulative housing, a number of cables electrically connected to the conductive terminals and a cover mold on and enclosing the outer of the metal shell and the cable.

For the improvement of the technical requirement, many technical solutions have been proposed. E.g. How to improve the function of prevention EMI for cable assembly. CN Pat. No. CN201081834Y, issued on Jul. 2, 2008, disclosed a cable assembly including an insulative main housing having a mating interface, a plurality of terminals located in the insulative main housing and exposed out of the mating interface, a first metal shell, a second metal shell and an insulative cover. The first metal shell is sheet structure and includes a front portion enclosing the insulative main housing and a rear portion extending rearwardly from the rear end of the front portion and forming half frame structure. The second metal shell is fastened the rear portion of the first metal shell to form an integrated frame structure. A junction line is formed between the first metal shell and the second metal shell, and the junction may be split during in the using time, thus, the function preventing EMI can be weaken.

As discussed above, an improved cable assembly overcoming the shortages of existing technology is needed.

SUMMARY OF THE INVENTION

Accordingly, an object of the present invention is to provide a cable assembly prevented form EMI.

In order to achieve the above-mentioned objects, a cable assembly, comprising a housing having a main portion, a plurality of conductive terminals received in the main portion of the housing, a cable having a plurality of wires and a metal shell with a no-joint-line surface enclosing the housing and comprising a front portion enclosing the housing and a rear portion enclosing the cable and a receiving space passing through the front portion and the rear portion.

Other objects, features and advantages of the invention will be apparent from the following detailed description taken in connection with the accompanying drawings.

DETAILED DESCRIPTION OF PREFERRED EMBODIMENTS

Figure 1:
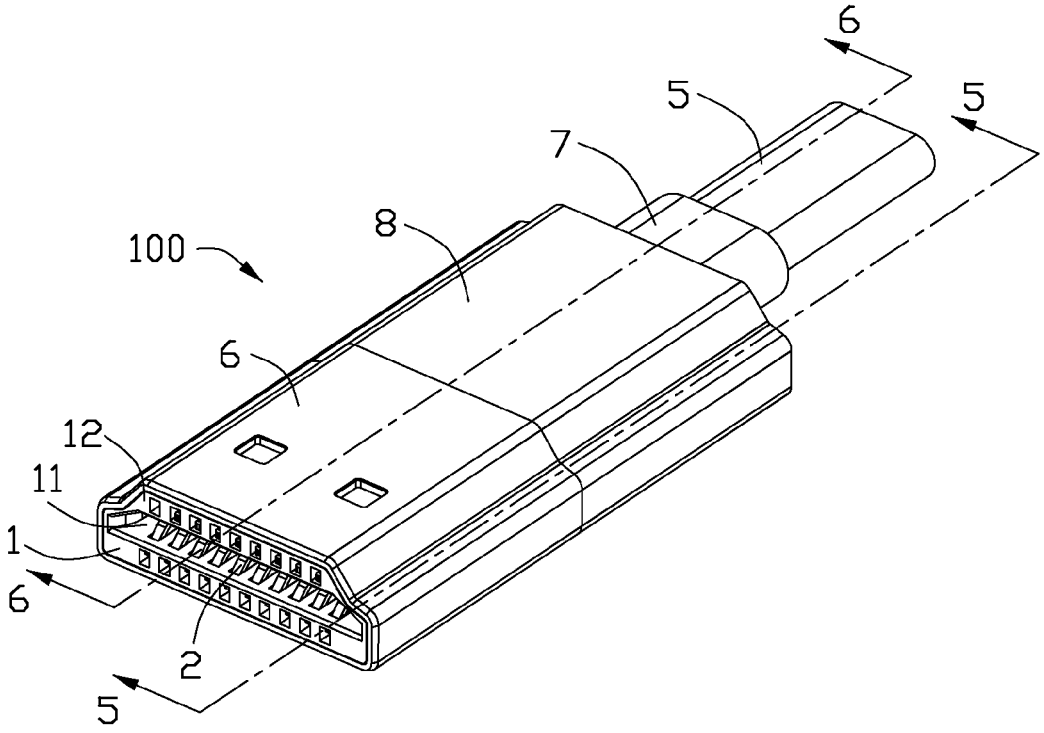
FIG. 1 is a perspective view of a cable assembly in accordance with the present invention.

Reference will now be made to the drawing figures to describe the present invention in detail.

Figure 2:
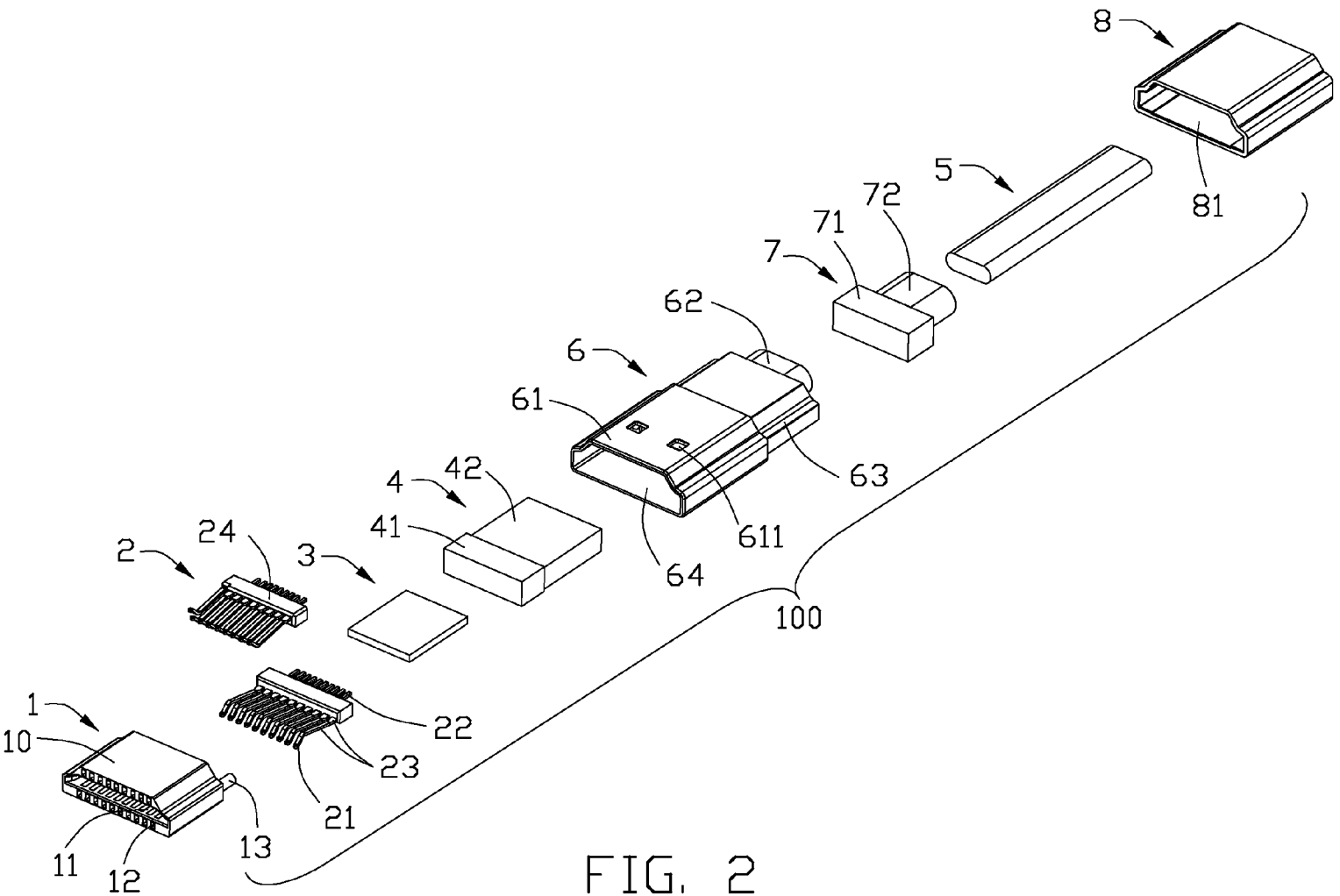
FIG. 2 is an exploded, perspective view of the cable assembly shown in FIG. 1.
Figure 3:
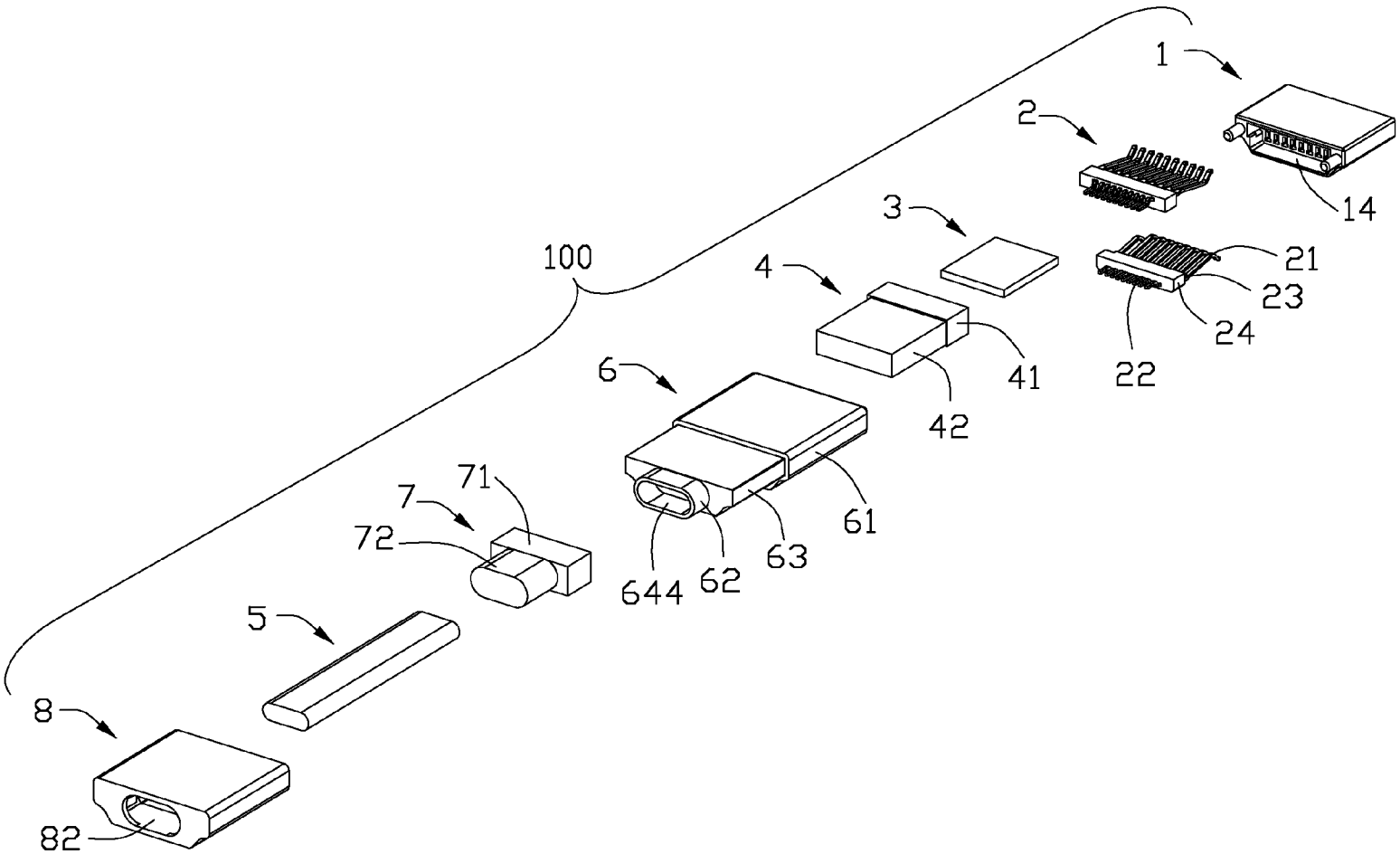
FIG. 3 is a view similar to FIG. 2, from another aspect.
Figure 4:
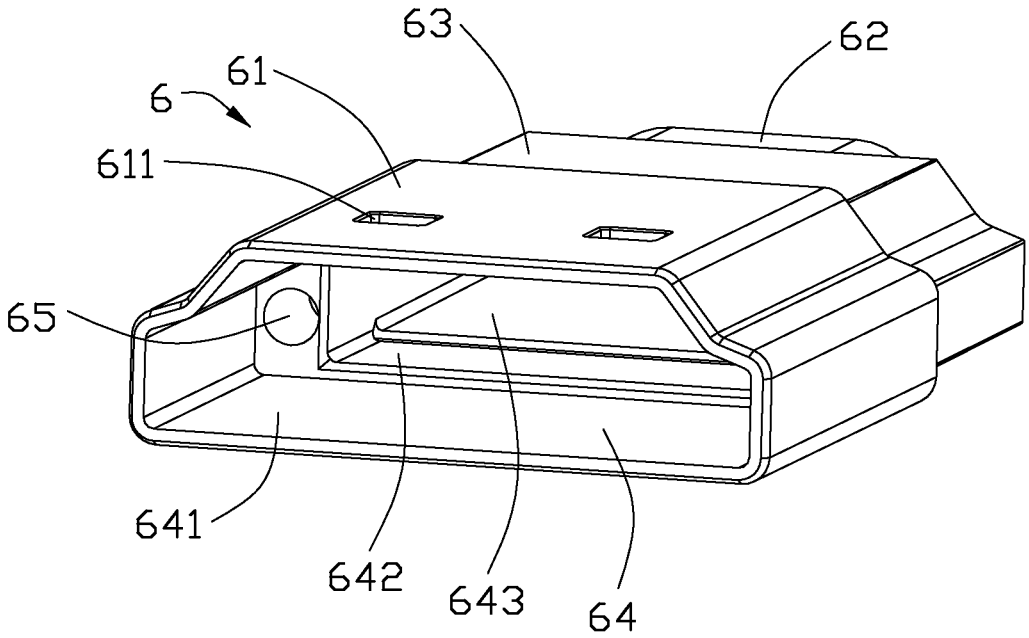
FIG. 4 is an enlarged view of a metal shell of the cable assembly in accordance with the present invention.
Figure 5:
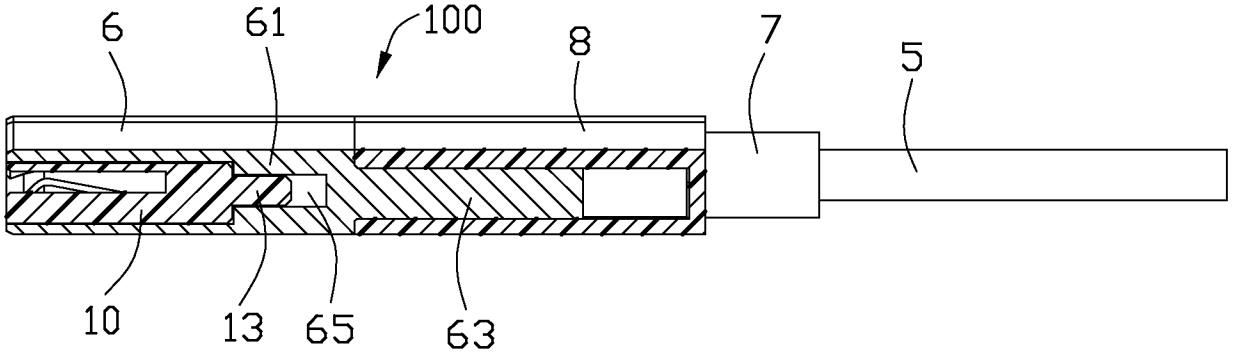
FIG. 5 is a cross section view of the cable assembly of FIG. 1 taken along line 5-5.
Figure 6:
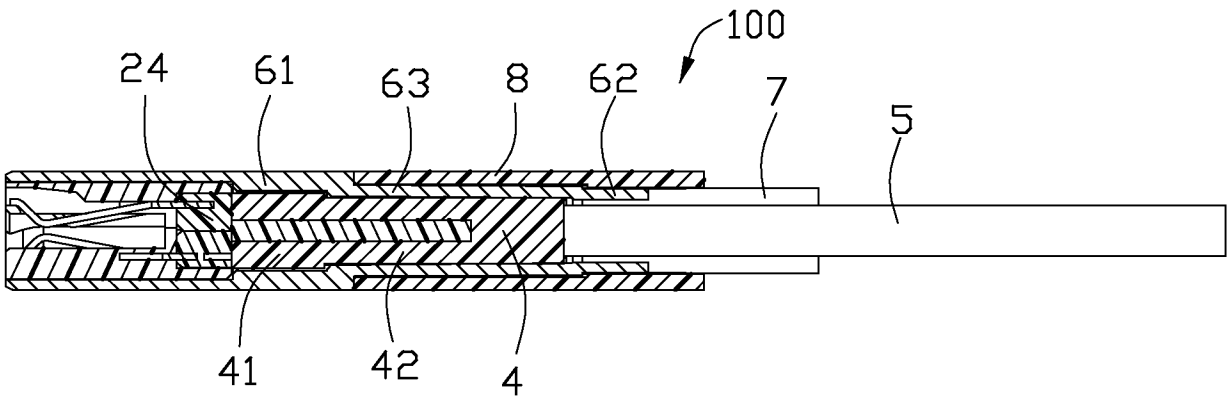
FIG. 6 is a cross section view of the cable assembly of FIG. 1 taken along line 6-6.

Referring to FIGS. 1 to 6, a cable assembly 100 in accordance with the present invention comprises a housing 1, a plurality of conductive terminals 2 received in the housing 1, a printed circuit board (PCB) 3 assembled on the rear end of conductive terminals 2, an inner molding 4 enclosing the printed circuit board 3, a cable 5 having a plurality of wires (not shown), a metal shell 6 enclosing the housing 1, a strain relief portion 7 and a rear cover 8 assembled on the metal shell 6.

The housing 1 comprises a main portion 10, a pair of cylinders 13 extending rearwardly from the rear surface of the main portion 10 and a receiving slit 14 recessing forwardly from the rear surface of the main portion 10. The main portion 10 comprises a trapeziform receiving plug space 11 with four walls for connecting to a complementary connector (not shown) and a plurality of terminal slits 12 located on the upper and lower walls thereof for receiving the conductive terminals 2. The terminal slits 12 is respectively communicated with the receiving slit 14 and the plug space 11. The conductive terminals 2 are arranged in two rows and each conductive terminal 2 includes a mating portion 21 located on the front end thereof, a soldering portion 22 located on the rear end thereof and a connecting portion 23 connecting the soldering portion 22 with the mating portion 21. A pair of mounting sleeves 24 are respectively molded on the surface of the connecting portions 23 of two rows of conductive terminals 2. In other embodiments, two rows of the conductive terminals 2 can be received in the mounting sleeves 24 for corresponding to the receiving slit 14.

The upper and lower surface of the PCB 3 has a lot of conductive films (not shown) soldered on the soldering portions 22 of the conductive terminals 2. The inner molding 4 which is made by injection molding method and from PE (Polyethylene) includes a bigger first step portion 41 located on the front thereof and a smaller second step portion 42 located on the rear end thereof. In other embodiment, the inner molding 4 also can be made from other insulative materials. The cable 5 is flat.

The metal shell 6 with no-joint-line surface is made from Zinc Alloy. The metal shell 6 includes a front portion 61 enclosing the housing 1, a rear portion 62 enclosing the cable 5, an intermediate portion 63 between the front portion 61 and the rear portion 62, a receiving space 64 passing through the front portion 61, intermediate portion 63 and the rear portion 62 and a pair of receiving holes 65 located in the receiving space 64 and corresponding to the cylinders 13 of the housing 1. The front portion 61 has a pair of fastening slots 611 located on the upper surface thereof for mating to the complementary connector. The receiving space 64 includes a first space 641 recessing rearwardly from the front surface of the metal shell 6 and receiving the main portion 10 of the housing 1, a second space 642 extending rearwardly from the first space 641 and receiving the first step portion 41 of the inner molding 4, a third space 643 extending rearwardly from the second space 642 and receiving the second step portion 42 of the inner molding 4 and a fourth space 644 communicating with the third space 643 and passing through the rear portion 62. The first space 641 and the second space 642 locate in the front portion 61 and the third space 643 located in the intermediate portion 63.

The strain relief portion 7 is made from PVC (poly vinyl chloride) and includes a rectangular first section 71 enclosing the rear portion 62 of the metal shell 6 and a flat second section 72 enclosing the cable 5. The first section 71 is bigger than the second section 72.

The rear cover 8 is made from metal material, and in other embodiment, the rear cover 8 also can be made from plastic or other insulative material. The rear cover 8 has a recessing space 81 recessing rearwardly from the front surface thereof and a through hole 82 penetrating the rear wall thereof. The recessing space 81 accommodates the intermediate portion 63 and the rear portion 62.

In assembly, firstly, two mounting sleeves 24 are molded respectively on the connecting portions 23 of two rows of the conductive terminals 2. Secondly, each row of conductive terminals 2 are inserted into the main portion 10 from the rear end to the front end of the main portion 10 along the terminal slits 12, and stretch into the plug space 11 for electrically mating the complementary connector. Thirdly, two mounting sleeves 24 are respectively inserted into and fill the receiving slit 14 of the housing 1 to make the front surface of the mounting sleeve 24 attach to the front surface of the receiving slit 14 and the rear surface of the mounting sleeve 24 be aligned with the rear surface of the main portion 10. Fourthly, two rows of soldering portions 22 of the conductive terminal 2 are soldered respectively to the conductive films (not shown) on the upper and lower surface of the PCB 3, and the wires of the cable 5 are soldered on the PCB 3. Lastly, the inner molding 4 is molded on and encloses the PCB 3, and then the inner molding 4 encloses the conductive terminal 2 exposed out of the rear end of the main portion 10 of the housing 1 and a part of the cable 5.

The metal shell 6 is assembled on the housing 1 from rear to front with the cable 5 passing through the receiving space 64 of the metal shell 6 to make the rear surfaces of the main portion 10 and the mounting portion 24 attach to the inner rear surface of the first space 641. At the same time, the outer surface of the main portion 10 attaches to the inner surface of the first space 641, a pair of cylinders 13 respectively are received in the receiving holes 65 for fixing the housing 1. The rear surface of the first step portion 41 of the inner molding 4 attaches to the rear surface of the second space 642 of the receiving space 64. the first step portion 41 of the inner molding 4 is received in the second space 642, the second step portion 42 is received in the third space 643, and the cable 5 is received in the fourth space 644.

The rear portion 63 of the metal shell 6 is enclosed the first section 71 of the strain relief portion 7, and the cable 5 is enclosed the second section 72. The cable 5 passes through the recessing space 81 of the rear cover 8 and the through hole 82 to make the front surface of the rear cover 8 attach the front portion 61 of the metal shell 6, the receiving space 81 receives the intermediate portion 63 of the metal shell, and both are interference fix. Both the outer surfaces of the rear cover 8 and the front portion 61 of the metal shell 6 are alignment.

As the metal shell 6 is mold as a integer, and completely encloses the conductive terminals 2, the housing 1, the PCB 3 and the inner molding 4 for reducing or eliminating EMI of the cable assembly 100.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

a housing having a main portion with a rear surface and a pair of cylinders extending rearwardly from the rear surface of the main portion;

a plurality of conductive terminals received in the main portion of the housing;

a cable having a plurality of wires; and a metal shell with a no-joint-line surface enclosing the housing, and comprising a front portion enclosing the housing and a rear portion enclosing the cable and a receiving space passing through the front portion and the rear portion, and the metal shell further comprising a pair of receiving holes respectively receiving the cylinders for fixing the housing.

2. The cable assembly as recited in claim 1, wherein the rear surface of the main portion of the housing attaches to the inner rear surface of the receiving space of the metal shell.

3. The cable assembly as recited in claim 1, wherein the cable assembly also comprises a strain relief portion enclosing the cable and the rear portion of the metal shell.

4. The cable assembly as recited in claim 1, wherein the cable assembly further comprises a pair of mounting sleeves molded respectively on the two rows conductive terminals.

5. The cable assembly as recited in claim 4, wherein the housing also comprises a receiving slit recessing forwardly from the rear surface of the main portion, the mounting sleeves are fill in the receiving slit.

6. The cable assembly as recited in claim 5, wherein the front surface of the mounting sleeves attaches to the front surface of the receiving slit, and the rear surface of the mounting sleeves are aligned with the rear surface of the main portion.

7. The cable assembly as recited in claim 6, wherein the cable assembly further comprises a rear cover assembled on the metal shell.

8. The cable assembly as recited in claim 7, wherein the outer surface of the rear cover is aligned with the outer surface of the front portion.

9. A cable assembly, comprises:

a housing having a main portion;

a plurality of conductive terminals received in the main portion of the housing;

an inner molding enclosing the conductive terminals;

a cable having a plurality of wires; and a metal shell with no-joint-line surface enclosing the housing, defining a front surface, and comprising a first space recessing rearwardly from the front surface thereof, a second space extending rearwardly from the first space and receiving partly the inner molding, a third space extending rearwardly from the second space and receiving another part inner molding and a fourth space communicating with the third space receiving the cable, the metal shell further comprising at least one receiving hole beside the second space and facing towards to be communicated with the first space.

10. The cable assembly connector as recited in claim 9, wherein the housing comprises at least one cylinder received in the at least one receiving hole.

11. The cable assembly as recited in claim 9, wherein the inner molding comprises a bigger first step portion received in the second space and a smaller second step portion received in the third space.

12. The cable assembly as recited in claim 11, wherein the rear surface of the main portion of the housing attaches to the rear surface of the first space, the rear surface of the first step portion attaches the rear surface of the second space.

13. The cable assembly as recited in claim 9, wherein the cable assembly further comprises a rear cover assembled on the metal shell, the outer surface of the rear cover is aligned to the outer of the metal shell.

14. The cable assembly as recited in claim 13, wherein the metal shell comprises a front portion enclosing the housing, a rear portion enclosing the cable and an intermediate portion between the front portion and the rear portion.

15. The cable assembly connector as recited in claim 14, wherein the rear cover is assembled on the intermediate portion of the metal portion.

16. The cable assembly connector as recited in claim 15, wherein the rear cover is made from metal material.

17. A cable connector assembly comprising:

a unitary metallic shell made from a die-casting process and defining a front portion and a rear portion;

an insulative housing disposed in the front portion under condition that said housing and said shell include means for rearwardly assembling the housing into the front portion of the shell along a front-to-back direction;

a plurality of terminals disposed in the housing with tails extending rearwardly beyond a rear face of the housing;

a cable connected to the rear portion and having corresponding wires electrical connected to the corresponding tails; and a strain relief portion located behind the shell and grasping the cable;

wherein said means for assembling further includes an alignment mechanism, in the front-to-back direction, including a cylinder and a receiving hole.

18. The cable connector assembly as claimed in claim 17, wherein the housing defines a receiving slit in a rear end to receive a mounting sleeve which unifies the terminals.

19. The cable connector assembly as claimed in claim 18, wherein a printed circuit board is located behind the housing and within the rear portion of the shell, upon which the tails are mounted to a front area thereof and the wires are mounted to a rear area thereof.

* * * * *